US011443704B1

(12) United States Patent
Chiang et al.

(10) Patent No.: US 11,443,704 B1
(45) Date of Patent: Sep. 13, 2022

(54) BACKLIGHT DIMMING METHOD AND CONTROL CIRCUIT FOR VARIABLE REFRESH RATE DISPLAY, AND DISPLAY APPARATUS USING SAME

(71) Applicant: ANAX TECHNOLOGY CORP., Zhubei (TW)

(72) Inventors: Sung-Wei Chiang, Zhubei (TW); Shih-Yu Hsieh, Zhubei (TW); Hung-Cheng Chang, Zhubei (TW)

(73) Assignee: ANAX TECHNOLOGY CORP., Zhubei (TW)

( * ) Notice: Subject to any disclaimer, the term of this patent is extended or adjusted under 35 U.S.C. 154(b) by 0 days.

(21) Appl. No.: 17/487,591

(22) Filed: Sep. 28, 2021

Related U.S. Application Data

(60) Provisional application No. 63/196,553, filed on Jun. 3, 2021.

(51) Int. Cl.
*G09G 3/34* (2006.01)
*G09G 5/10* (2006.01)

(52) U.S. Cl.
CPC ..... *G09G 3/3426* (2013.01); *G09G 5/10* (2013.01); *G09G 2320/064* (2013.01); *G09G 2320/0686* (2013.01)

(58) Field of Classification Search
CPC .. G09G 3/3426; G09G 5/10; G09G 2320/064; G09G 2320/0686
See application file for complete search history.

(56) References Cited

FOREIGN PATENT DOCUMENTS

DE 102012210533 * 1/2013 ..... G09G 3/34

* cited by examiner

*Primary Examiner* — Towfiq Elahi
(74) *Attorney, Agent, or Firm* — Guice Patents PLLC

(57) ABSTRACT

A backlight dimming method for backlighting an LCD panel having a variable refresh rate with an LED module, the variable refresh rate having a maximum refresh rate, the LED module having at least one LED sub-zone, the LED sub-zone including a plurality of LEDs, and the method including: using a controller to generate a secondary synchronizing signal having a frequency higher than the maximum refresh rate; and using the controller to update dimming values for the at least one LED sub-zone at one or more pulses of the secondary synchronizing signal with current dimming data after the controller has received the current dimming data from a scaler.

12 Claims, 14 Drawing Sheets

BACKLIGHT DIMMING METHOD AND CONTROL CIRCUIT FOR VARIABLE REFRESH RATE DISPLAY, AND DISPLAY APPARATUS USING SAME

PRIORITY CLAIM

This application claims priority to U.S. provisional application Ser. No. 63/196,553 filed on Jun. 3, 2021; the contents of which are incorporated by reference.

BACKGROUND OF THE INVENTION

Field of the Invention

The present invention relates to a backlight dimming method for a display device, more particularly to a backlight dimming method for a display device providing variable frame rate.

Description of the Related Art

A useful means of providing visual displays for computer monitors, notebook computers, cell phones, televisions, and large advertising displays utilizes LCD (Liquid Crystal Display) technology. Each pixel of the display has a substance whose molecules twist and untwist in response to electrical voltages. As the molecules twist and untwist, in response to electrical stimulus, their optical properties change. Light passing through the individual pixels of these LCD panels will be changed according to the optical properties of each pixel. If those optical properties change as a function of time a video image can be produced.

In order to provide a vibrant image, these LCD panels are illuminated from behind by a light source, commonly called a "backlight". The majority of these backlights are made from LED (light emitting diodes) in an array behind the LCD panel. The simplest backlight would provide uniform illumination across the LCD panel. However, if we divide the backlight into zones of LED devices, and allow the brightness of the zones to change individually, we can maximize the contrast ratio of the video image and at the same time save power.

For example, as the video image changes, some portion of the display goes darker for a certain length of time. In those areas the backlight intensity can be decreased, making the dark areas darker and conserving power at the same time. In a like manner the bright areas of the display can have the backlight intensity increased leading to a brighter, sharper image in those areas. The different backlight dimming zones constantly change intensity to stay synchronized with the video image produced by the LCD panel. This technique is called local dimming.

The LED backlight data and the LCD data (or image data) emanate from a device called a "scaler". The backlight data is input into the Backlight Controller (BCON). In actual implementation the BCON block is made from a Microcontroller Unit (MCU). The LCD data exits the scaler on a different data path and drives a device called the Timing Controller (TCON). The output of the TCON drives a Source Driver block. The source drivers produce signals that control every LCD pixel in the display. An abstract drawing of this concept is shown in FIG. 1. As can be seen in FIG. 1, a scaler 10 outputs a vertical synchronization signal VSYNC to control a timing controller 11, a backlight controller 12, an LED driver circuit 14 and an LED backlight array 16 having backlight zones 16*a*; provides backlight data to the backlight controller 12 synchronized to the vertical synchronization signal VSYNC; and provides LCD data to the timing controller 11 synchronized to the vertical synchronizing signal V SYNC.

The timing controller 11 is responsible for delivering the LCD data to a source driver circuit 13, and the source driver circuit 13 is responsible for driving LCD pixels 15*a* of an LCD panel 15; the backlight controller 12 is responsible for delivering the backlight data to the LED driver circuit 14, and the LED driver circuit 14 is responsible for driving the backlight zones 16*a* (z1-z16) of the LED backlight array 16.

In real world applications there could be thousands of these backlight zones 16*a*. The LCD panel 15 is placed on top of the LED backlight array 16 so that the light from the LED backlight array 16 shines through the LCD panel 15. The scaler 10 sends the synchronizing signal VSYNC to the backlight controller 12 and the timing controller 11. As the name implies, VSYNC is used to ensure that the LED backlight image remains synchronized with the LCD display image.

Every time a pulse occurs on VSYNC a new frame of video data is transmitted to the LCD panel 15 and the LED backlight array 16. The frequency of VSYNC is typically (but not necessarily) between 48-170 Hz. The frequency is important for video quality. With some notable exceptions, higher VSYNC frequency leads to higher video quality. In certain situations the VSYNC frequency can "beat" with another frequency in the system. When this happens the video image can display what is called a "falling water" pattern. The falling water pattern is not desirable. This often happens when the VSYNC frequency is near integer multiples of the power supply frequency, which in most countries is 50 Hz to 60 Hz.

The LED zone brightness is controlled by adjusting the current through those LEDs from which a particular zone is made. An LED "driver" accomplishes this function. The LED current for a particular zone is turned on and off at a certain frequency and duty cycle in order to produce the desired zone brightness. Traditionally the frequency and duty cycle of those on and off pulses are synchronized with the VSYNC signal. The amplitude of the LED current, when it is turned on can also be adjusted. In following figures (FIG. 2 and FIG. 3) the LED driving function and the LED zones are shown incorporated into one block with the LCD data path (the timing controller 11 to source driver circuit 13 to LCD panel 15) left out.

The backlight controller 12 is used to format the LED zone brightness information from the scaler 10 into a form that is compatible with the LED drivers 14. Often the backlight zones 16*a* are grouped together in sub-zones 20*a* so the backlight controller 12 has the capacity to properly distribute the LED brightness control information to the proper subzones 20*a*. Traditionally the backlight controller 12 and the timing controller 11 are synchronized to the VSYNC signal. The brightness data is usually communicated in a serial fashion (often SPI format, but not necessarily so) in order to minimize the routing complexity required on whatever substrate the backlight LEDs and drivers are mounted. This substrate plus the LEDs and LED drivers are known as a BackLight Unit (BLU) 18 or a sub-BLU 20.

Since the required number of backlight zones 16*a* may be in the thousands, those zones can be grouped together in sub-zones 20*a* (FIG. 3). A sub-zone 20*a* may contain as little as one LED zone and one driver or up to as many as the design requires. The sub-zones 20*a* may be of the passive matrix type (PM, where rows of LED zones are sequentially illuminated in a rolling fashion), or of the active matrix type (AM, where all rows of the subzones are illuminated at essentially the same time).

In all these previous scenarios each frame of data is updated synchronous to the VSYNC signal, which in turn is synchronized to the LCD data which emanates from the scaler.

In traditional systems the VSYNC frequency is fixed. However, in recent systems the VSYNC frequency may vary in order to improve visual clarity and avoid the "beating" or "falling water" effects that were mentioned earlier. If the VSYNC frequency, emanating from the scaler 10 varies, then the backlight control signals from the scaler 10 into the backlight controller 12 and from the backlight controller 12 into the BLU 18 must change in the same fashion or else visual quality will be reduced.

This requirement presents a problem for many LED driving solutions. In some systems the subzone driver uses an internal clock that is generated from a phase locked loop (PLL) which uses the VSYNC signal as its frequency reference. All PLLs require a finite time to "lock" their output frequency to the reference frequency. During the time required to achieve a "lock" the VSYNC signal and the sub-zone internal clock signals will not be synchronized resulting in poor visual quality.

Another problem that may occur is that the subzone LED driving electronics may be optimized for a certain frequency and subsequently not able to run at different VSYNC frequencies or, as mentioned above, not be able to instantly change its synchronization frequency and maintain a phase lock with the VSYNC signal.

To solve the foregoing problems, a novel scheme for backlight dimming method is needed.

SUMMARY OF THE INVENTION

One objective of the present invention is to disclose a backlight dimming method, which utilizes an LED backlight module having a refresh rate independent from and higher than a variable refresh rate of an LCD panel, and the LED backlight module refreshes each received frame of dimming data one or more times, thereby supporting a variable refresh rate display. In addition, an LED driver circuit can be integrated in the LED backlight module to perform a continuous mode refresh procedure (dimming data continuously per each frame) or a N-shot mode refresh procedure (dimming data divided into multiple groups and applied in multiple sub-frames per frame) to increase the backlight refresh rate in order to improve display quality and performance.

Another objective of the present invention is to disclose a control circuit for implementing the aforementioned backlight dimming method to support a variable refresh rate display.

Still another objective of the present invention is to disclose a display apparatus having the aforementioned control circuit to support a variable refresh rate display.

To attain the foregoing objectives, a backlight dimming method for backlighting an LCD panel having a variable refresh rate with an LED module is proposed, the variable refresh rate having a maximum refresh rate, and the LED module having at least one LED sub-zone, the LED sub-zone including a plurality of LEDs, the method including:

using a controller to generate a secondary synchronizing signal having a frequency higher than the maximum refresh rate; and using the controller to update dimming values for the at least one LED sub-zone at one or more pulses of the secondary synchronizing signal with current dimming data after the controller has received the current dimming data from a scaler.

In one embodiment, the backlight dimming method further includes using at least one driver circuit to refresh the at least one LED sub-zone once with the current dimming data during a time period between two consecutive said pulses of the secondary synchronizing signal.

In one embodiment, the backlight dimming method further includes using at least one driver circuit to refresh the at least one LED sub-zone a plurality of times correspondingly with a plurality of groups of sub-dimming values during a time period between two consecutive said pulses of the secondary synchronizing signal, where the plurality of groups of sub-dimming values add up to the intended values of the current dimming data.

In one embodiment, the current dimming data is transmitted in a series format from the scaler.

In one embodiment, the current dimming data is derived by undergoing a series-to-parallel transformation.

To attain the foregoing objectives, the present invention further proposes a control circuit having a controller and at least one driver circuit for performing a backlight dimming method for backlighting an LCD panel having a variable refresh rate with an LED module, the variable refresh rate having a maximum refresh rate, the LED module having at least one LED sub-zone, the LED sub-zone including a plurality of LEDs, and the method including:

using the controller to generate a secondary synchronizing signal having a frequency higher than the maximum refresh rate; and using the controller to update dimming values for the at least one LED sub-zone at one or more pulses of the secondary synchronizing signal with current dimming data after the controller has received the current dimming data from a scaler.

In one embodiment, the backlight dimming method further includes using at least one driver circuit to refresh the at least one LED sub-zone once with the current dimming data during a time period between two consecutive said pulses of the secondary synchronizing signal.

In one embodiment, the backlight dimming method further includes using at least one driver circuit to refresh the at least one LED sub-zone a plurality of times correspondingly with a plurality of groups of sub-dimming values during a time period between two consecutive said pulses of the secondary synchronizing signal, where the plurality of groups of sub-dimming values add up to an aggregate brightness consistent with values of the current dimming data.

In one embodiment, the current dimming data is transmitted in a series format from the scaler.

In one embodiment, the current dimming data is derived by undergoing a series-to-parallel transformation.

To attain the foregoing objectives, the present invention further proposes a display apparatus including a control circuit, an LCD panel having a variable refresh rate and an LED module having at least one LED sub-zone, the LED sub-zone including a plurality of LEDs, the control circuit having a controller and at least one driver circuit for performing a backlight dimming method for backlighting the LCD panel with the LED module, the variable refresh rate having a maximum refresh rate, and the method including:

using the controller to generate a secondary synchronizing signal having a frequency higher than the maximum refresh rate; and using the controller to update dimming values for the at least one LED sub-zone at one or more pulses of the secondary synchronizing signal with current dimming data after the controller has received the current dimming data from a scaler.

In one embodiment, the at least one driver circuit is used to refresh the at least one LED sub-zone once with the current dimming data during a time period between two consecutive said pulses of the secondary synchronizing signal.

In one embodiment, the at least one driver circuit is used to refresh the at least one LED sub-zone a plurality of times correspondingly with a number of groups of sub-dimming values during a time period between two consecutive said pulses of the secondary synchronizing signal, where the plurality of groups of sub-dimming values add up to an aggregate brightness consistent with values of the current dimming data.

In one embodiment, the current dimming data is transmitted in a series format from the scaler.

In one embodiment, the current dimming data is derived by undergoing a series-to-parallel transformation.

To make it easier for our examiner to understand the objective of the invention, its structure, innovative features, and performance, we use preferred embodiments together with the accompanying drawings for the detailed description of the invention.

DETAILED DESCRIPTION OF THE PREFERRED EMBODIMENTS

To solve these problems this invention proposes to use two different synchronization signals. The backlight refresh rate will run at a secondary frequency (VSYNC2), which will always be significantly higher than the timing controller refresh rate (VSYNC1). For example, the VSYNC1 may be free to vary from 40 Hz to 170 Hz while the backlight will refresh at a secondary frequency of 240 Hz (VSYNC2).

Figure 1:
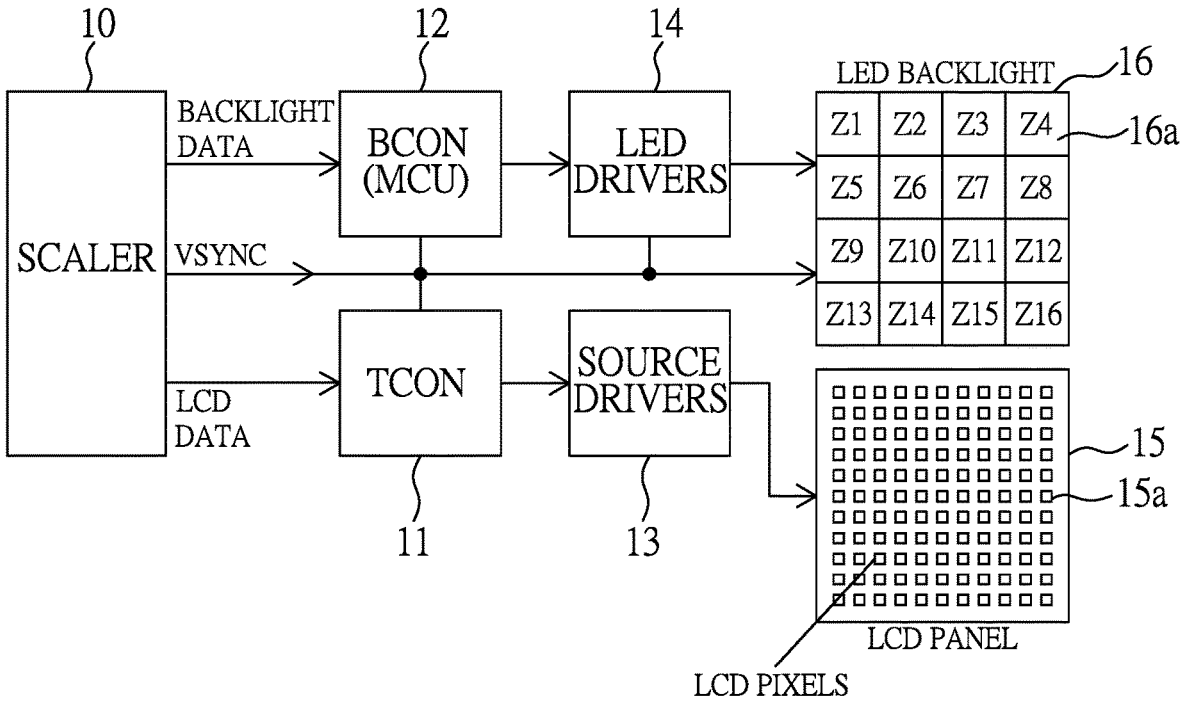
(PRIOR ART) FIG. 1
FIG. 1 illustrates an abstract drawing of the architecture of a traditional LCD apparatus.
Figure 2:
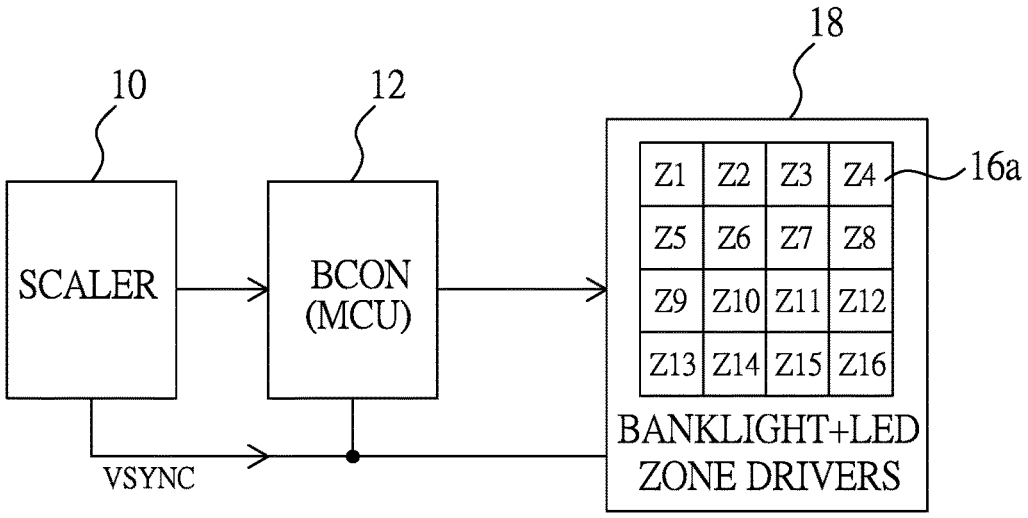
(PRIOR ART) FIG. 2
FIG. 2 illustrates a traditional backlight control circuit.
Figure 3:
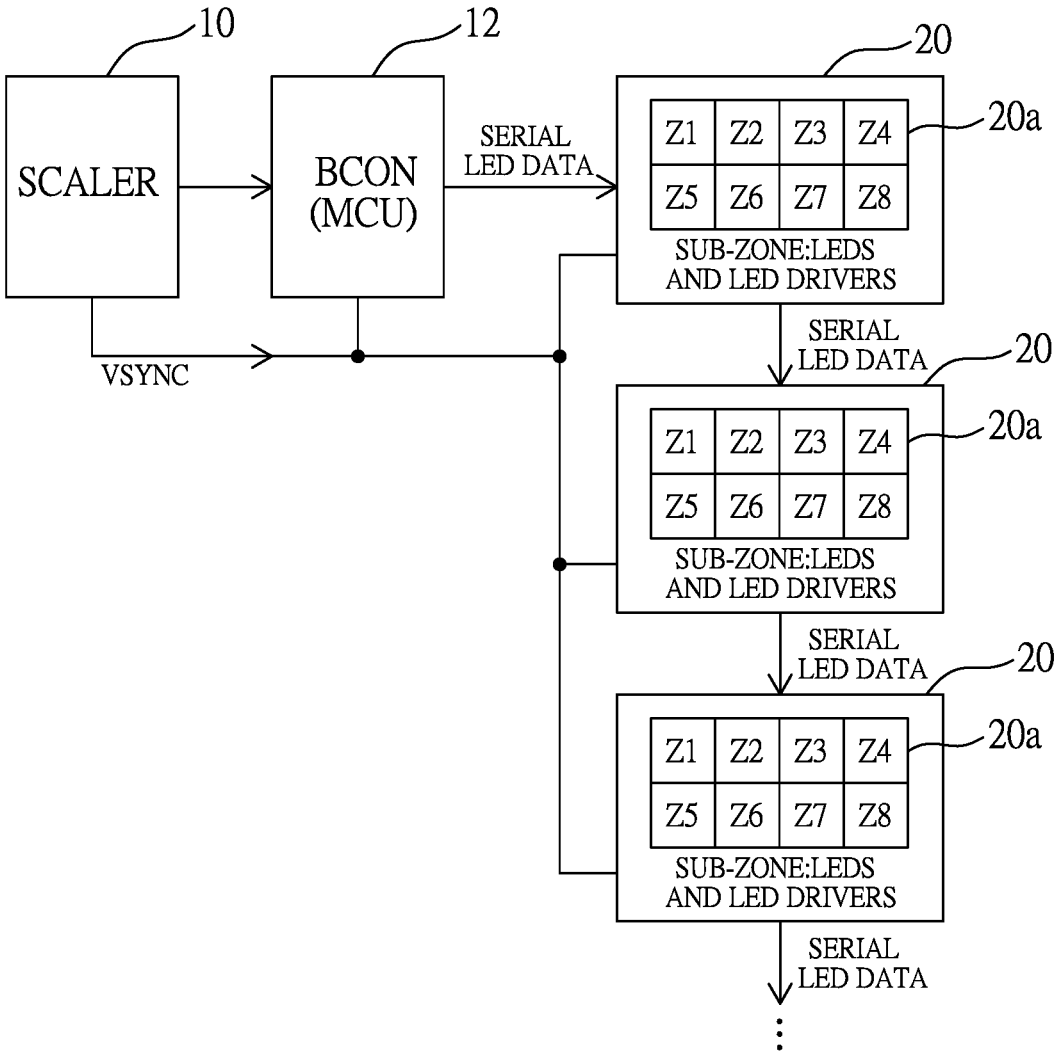
(PRIOR ART) FIG. 3
FIG. 3 illustrates another traditional backlight control circuit.
Figure 4:
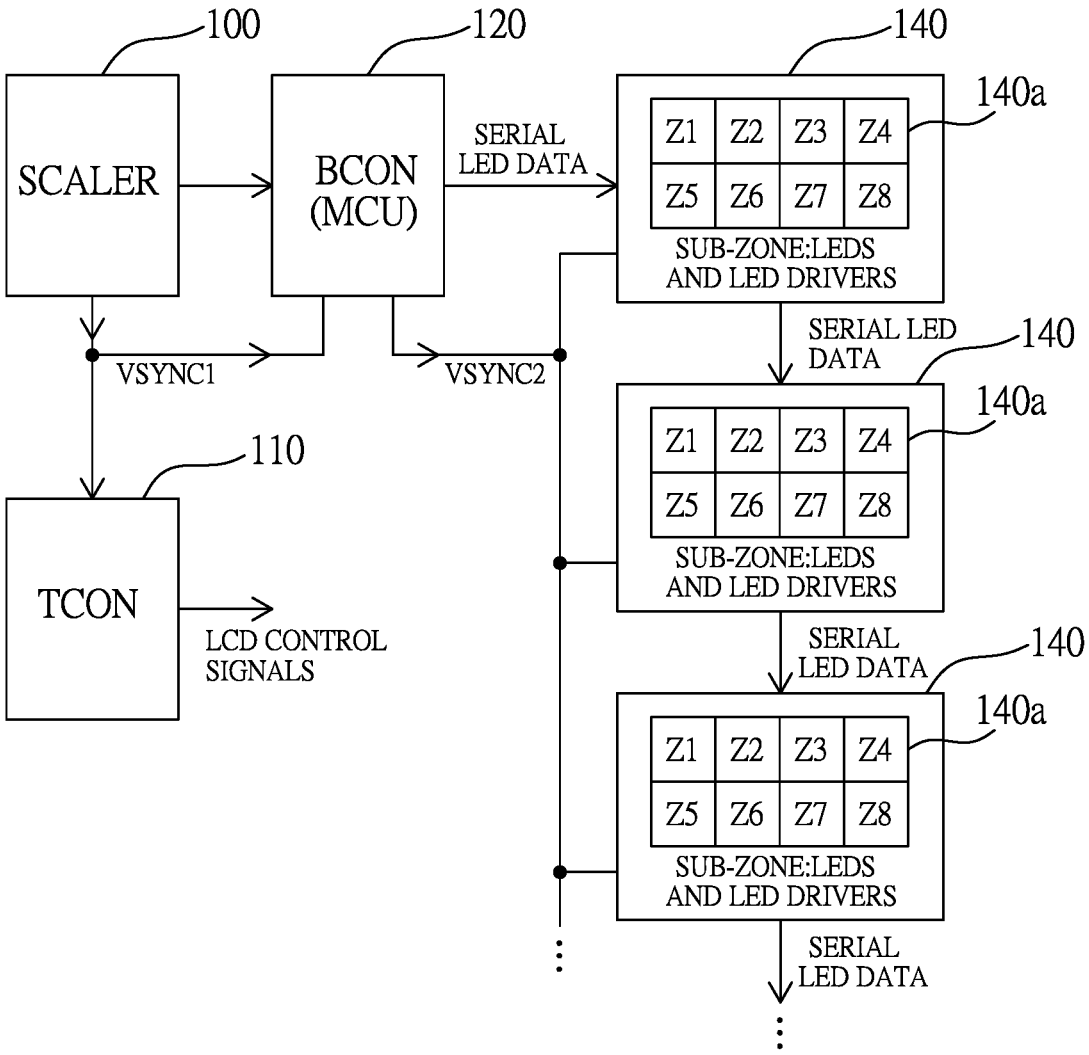
FIG. 4 illustrates a block diagram of a control circuit for performing a backlight dimming method of the present invention.

Please refer to FIG. 4, which illustrates a block diagram of a control circuit for performing a backlight dimming method of the present invention. As shown in FIG. 4, the control circuit includes a scaler 100, a timing controller 110, a backlight controller 120 and a plurality of LED sub-zone units 140 each having an LED sub-zone 140*a* and an LED driver circuit (not shown in the figure) integrated with the LED sub-zone 140*a*, the LED sub-zone 140*a* including 8 LED zones (Z1-Z8), and the LED driver circuit including 8 LED drivers for driving the 8 LED zones (Z1-Z8).

The backlight controller 120 is used to format the LED zone brightness data received from the scaler 100 at pulses of the VSYNC1 into a form that is compatible with the LED sub-zone units 140. The LED sub-zone units 140 operate synchronously to VSYNC2 in order to receive serial LED data from the backlight controller 120.

In addition, the backlight dimming method can further include using the LED driver circuits to refresh the LED sub-zones 140*a* once with the current dimming data during a time period between two consecutive pulses of the VSYNC2; or using the LED driver circuits to refresh the LED sub-zones 140*a* a plurality of times correspondingly with a plurality of groups of sub-dimming values during a time period between two consecutive said pulses of the VSYNC2, where the plurality of groups of sub-dimming values add up to an aggregate brightness consistent with the current dimming data. By using the sub-dimming values scheme, the display quality of an LCD panel can be further improved.

In addition, the current dimming data is transmitted in a series format from the scaler.

In addition, the current dimming data is derived by undergoing a series-to-parallel transformation.

Figure 5:
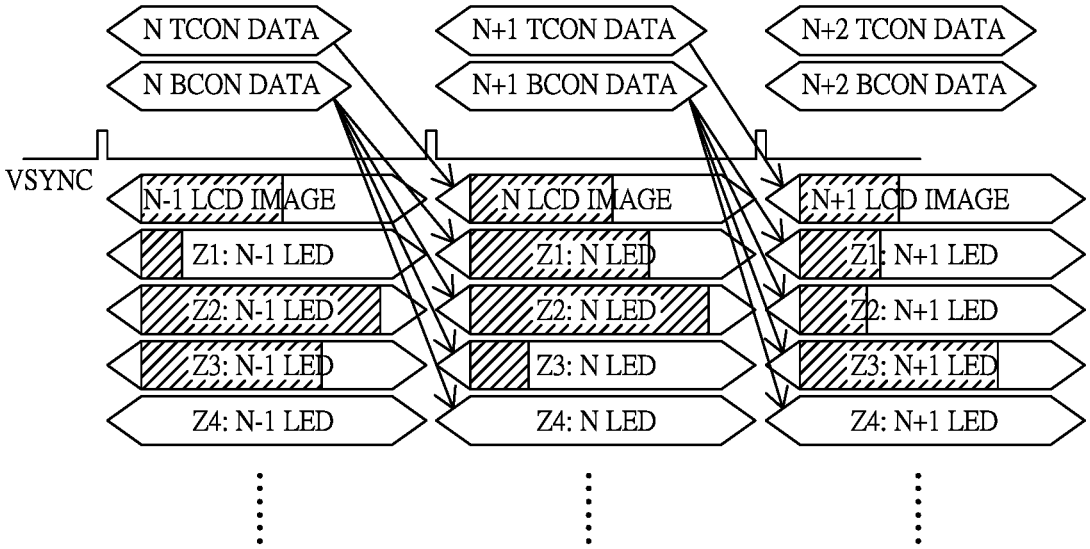
(PRIOR ART) FIG. 5
FIG. 5 shows a traditional operational timing scheme of an LCD apparatus.

The principle of the present invention is further elaborated as follows:

FIG. 5 shows a traditional timing scheme. The data for the Nth image is transferred during the N−1th frame. This holds true for both the LCD image data (from the TCON) and the LED backlight image (from the BCON). The LED image is displayed at the same rate as the LCD image. The shaded regions in FIG. 5 represent LED zone "on" times during the VSYNC periods. The perceived brightness is proportional to the amount of the time that the LEDs are on during a VSYNC period. The brightest backlight output occurs when the LEDs are on for the whole of the VSYNC period. In this representation the LCD image exists over the whole display. However, each of the LED blocks only represents one out of many LED zones on the BLU.

Figure 6:
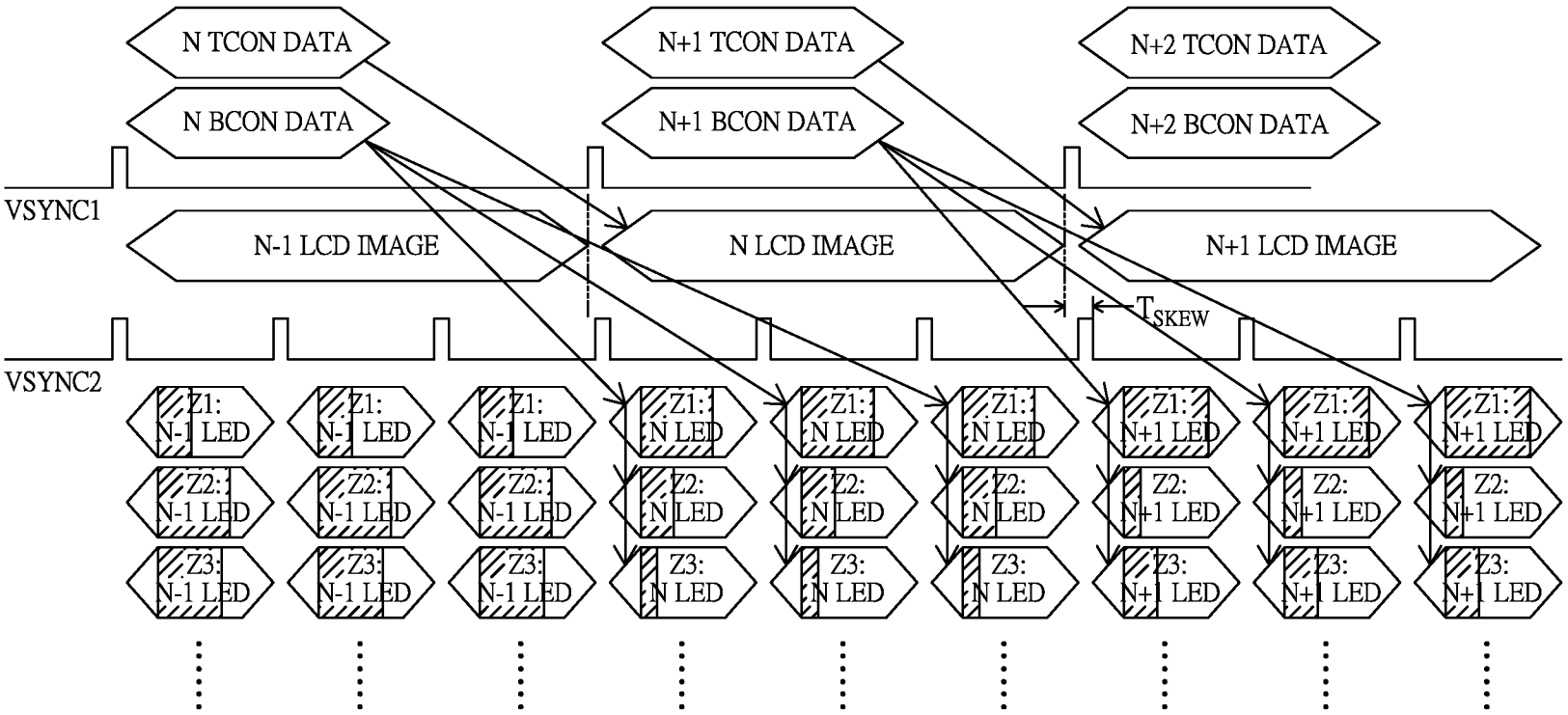
FIG. 6 shows an operational timing diagram for illustrating the principle of the present invention.

FIG. 6 shows the timing diagram for the proposed invention. In this situation there are two VSYNC signals, VSYNC1 which synchronizes the display data, and VSYNC2 which synchronizes the LED backlight zones. The two signals, VSYNC1 and VSYNC2, are not in phase nor are they the same frequency. VSYNC2 is a secondary frequency and is significantly faster than VSYNC1. For the purposes of explanation we allow 40 Hz<VSYNC1<170 Hz, and set VSYNC2=240 Hz. The TCON (timing control) data for the N+1th image comes from the Nth VSYNC1 period. In a like manner the BCON (backlight control) data for the N+1th LED zone brightness level comes from the Nth VSYNC1 period. The BCON converts the brightness data from the scaler into a higher frequency form.

As in FIG. 5 the shaded regions in FIG. 6 represent LED zone "on" times during the VSYNC2 periods.

Figure 7:
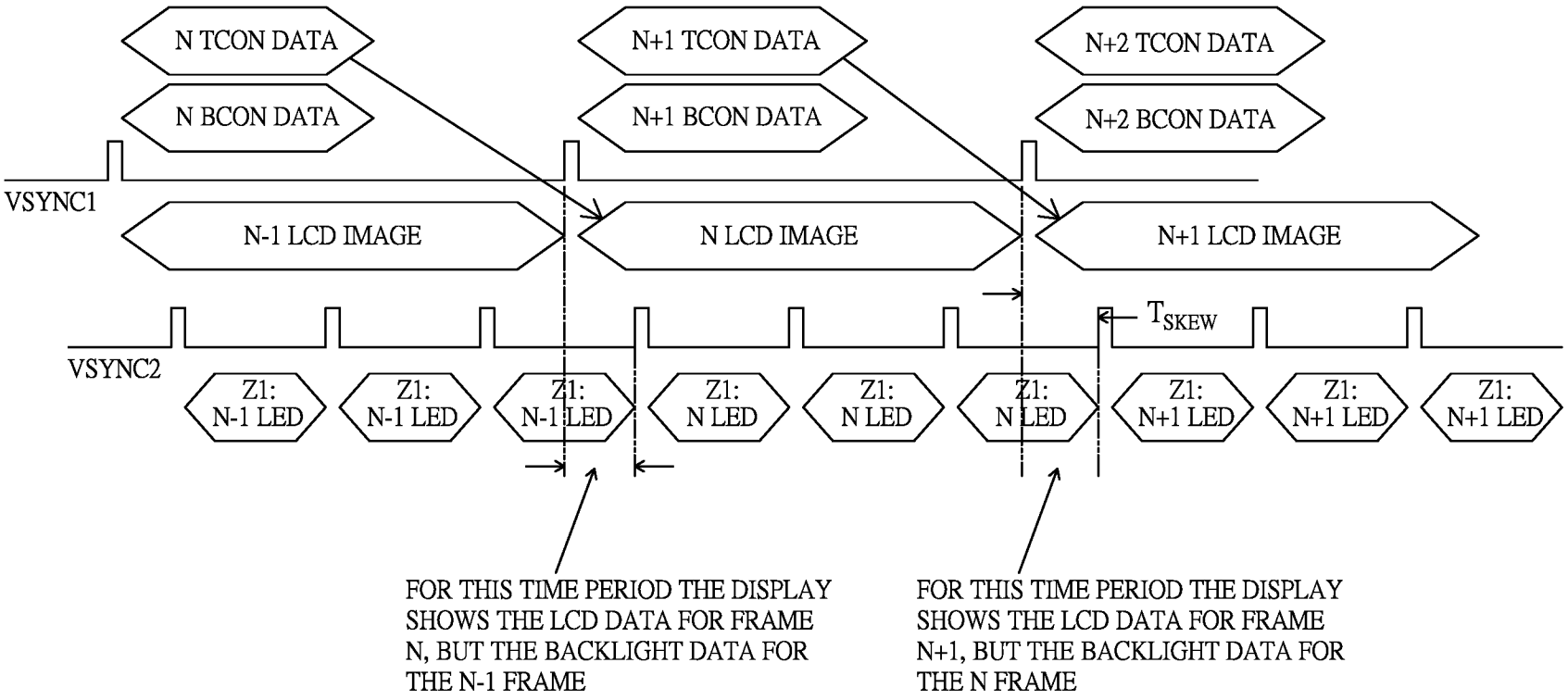
(PRIOR ART) FIG. 7
FIG. 7 illustrates a traditional operational timing diagram indicating a phase error between LCD frame to LED zone.

Since VSYNC1 and VSYNC2 are not synchronized there will be a variable time difference between the positive VSYNC1 edge and the next closest VSYNC2 edge, shown in FIG. 6 as $T_{SKEW}$. This means that the LED zone brightness data that is apparent during VSYNC1 period N will not be entirely from the Nth frame of the BCON. The MCU will choose the most optimum situation when it is parsing zone brightness data in order to minimize $T_{SKEW}$. This error in backlight zone brightness accuracy is not apparent to the user and, in general, improvements in image quality due to higher backlight frequency (VSYNC2) outweigh any LCD frame to LED zone phase error. This phenomenon is illustrated in FIG. 7.

Results from an actual implementation of this concept are shown in FIGS. 8, 9, 10, and 11. Each figure shows the same data but different aspects of the data are emphasized in the different figures. There are 4 traces in each figure. Starting with FIG. 8 the top trace shows the VSYNC1 signal as described earlier in this specification. The frequency varies from 40 Hz up to 170 Hz. The second trace shows the scaler data output. The scaler outputs two data streams: one for the LCD panel, and one for the LED backlight module. The LED and LCD data may be sent concurrently or on top of each other, it really does not matter. However, whether LED or LCD data is sent first, the complete frame's data must be sent within one VSYNC1 period.

Figure 8:
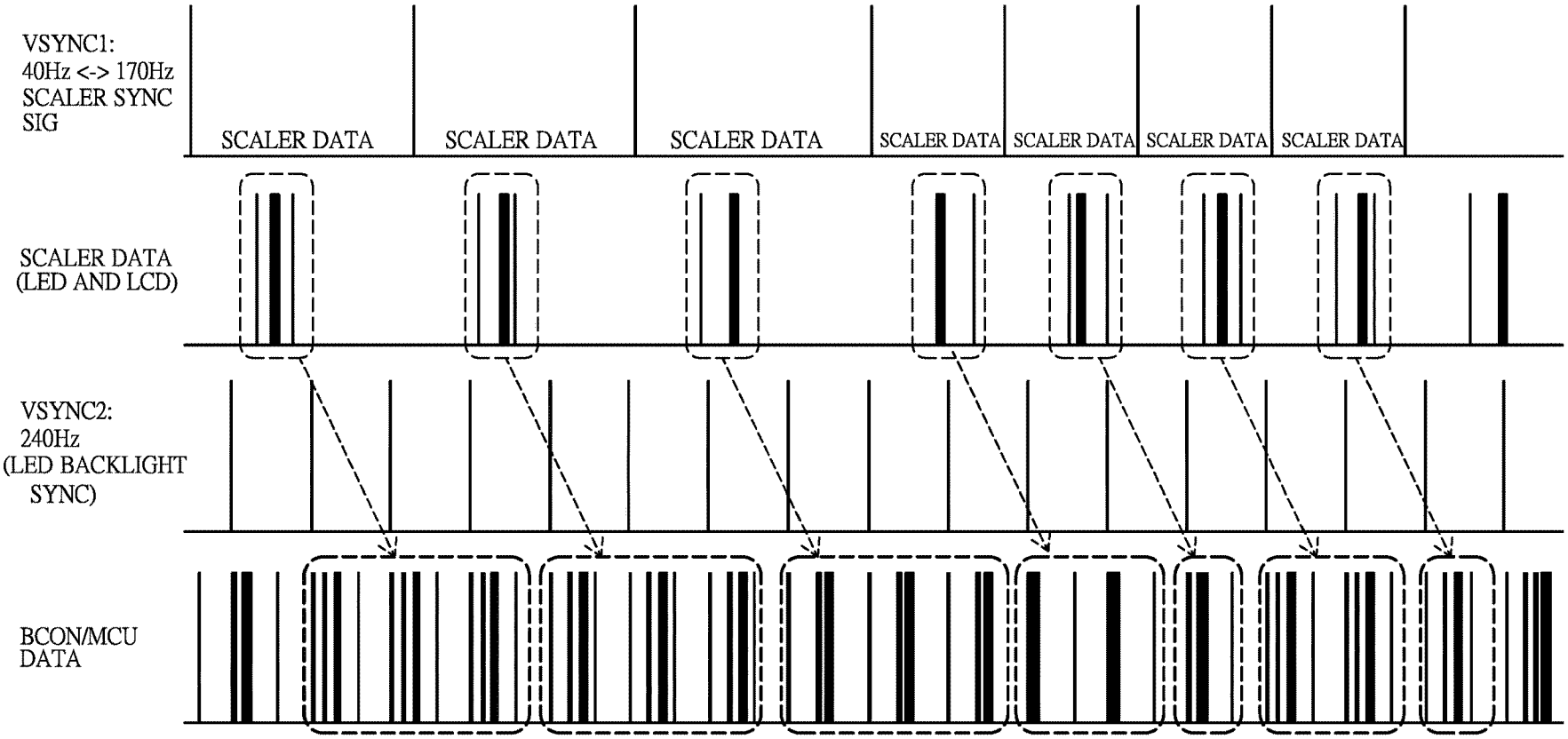
FIG. 8-11 illustrate the operational timing diagrams for better understanding the principle of the present invention.

The third trace in FIG. 8 (and FIGS. 9, 10, and 11) shows the VSYNC2 signal. Its frequency is 240 Hz, and that never varies in this example. All of the backlight zones turn on and off synchronous to this signal. Within one frame, after the scaler data has stopped for that frame, the BCON/MCU can send the LED brightness information to the LED drivers (bottom trace). For the first frame (FRAM1 in FIGS. 9 and 11) the scaler data is mapped by the BCON/MCU into 3 data bursts, each of which are synchronous to the VSYNC2 signal. At low VSYNC1 frequencies each frame is able to contain 3 identical bursts of BCON/MCU data. As the VSYNC1 frequency increases there is not enough time in the frame period for 3 bursts of data and one can see that the BCON/MCU output contains only 1 or 2 bursts as the VSYNC1 frequency increases. The BCON/MCU data (for a particular frame) only comes as an integer number of identical data bursts. There is no BCON/MCU output that is a fraction of the VSYNC2 period (although modifications to this scheme could provide fractional bursts).

Since the BCON/MCU data only comes in integer amounts synchronous to the VSYNC2 signal the LED brightness data (and LED output) will not be exactly in phase with the LCD data (synchronous to VSYNC1). This means that for some short time when the LCD data for frame N is being displayed, the backlight data (and backlight brightness image) will be from frame N−1. This mismatch between the LCD display image and the LED brightness image (previously called LCD frame to LED zone phase error) is virtually undetectable by the human eye. The fast LED brightness image update frequency (VSYNC2>>VSYNC1) makes for a net improvement in display image quality.

Figure 9:
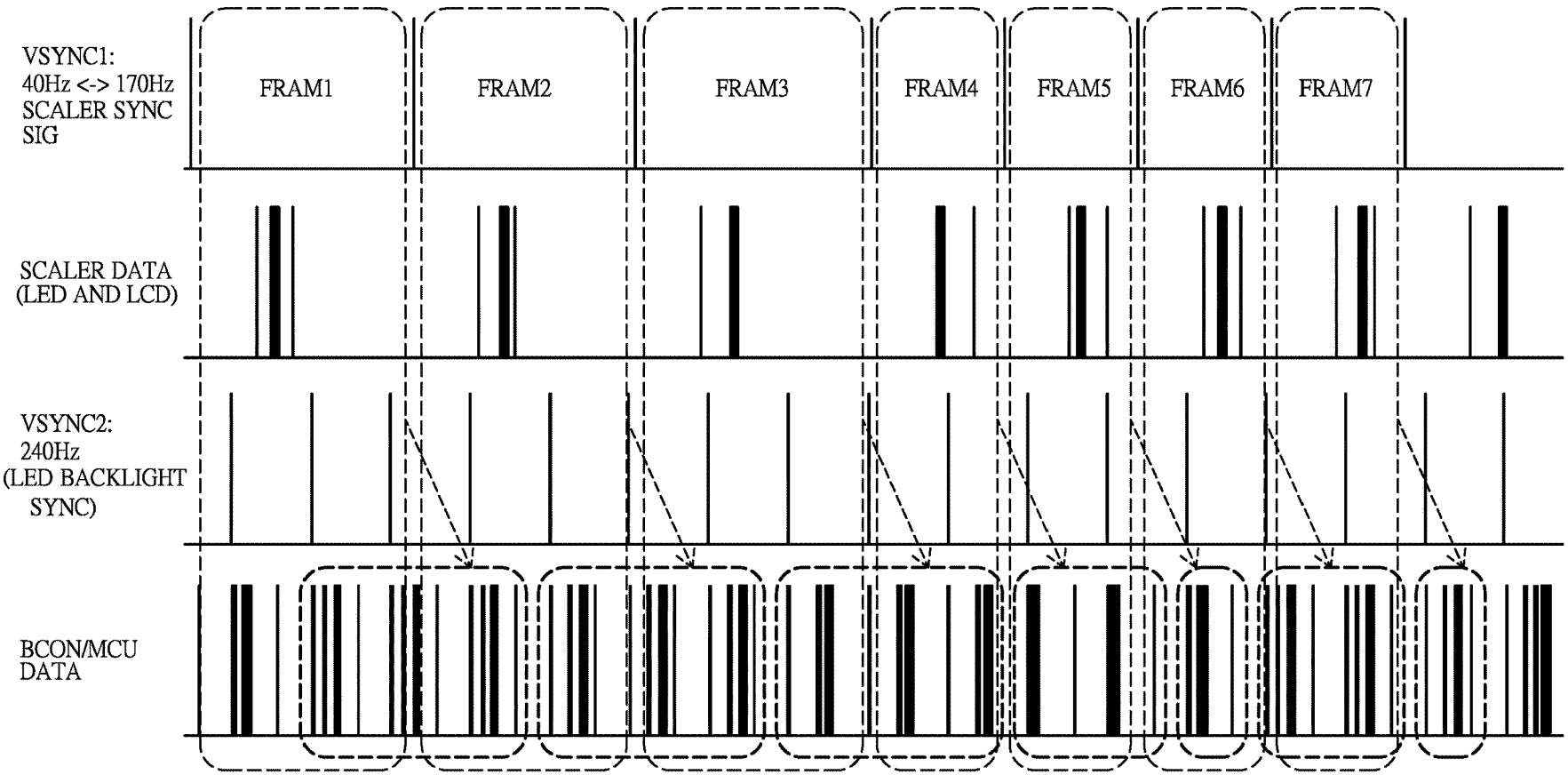

The next figure, FIG. 9 shows the same data but it emphasizes the concept of a "frame" of data being synchronous to the VSYNC1 signal. As the frequency of VSYNC1 increases the time of each frame decreases.

Figure 10:
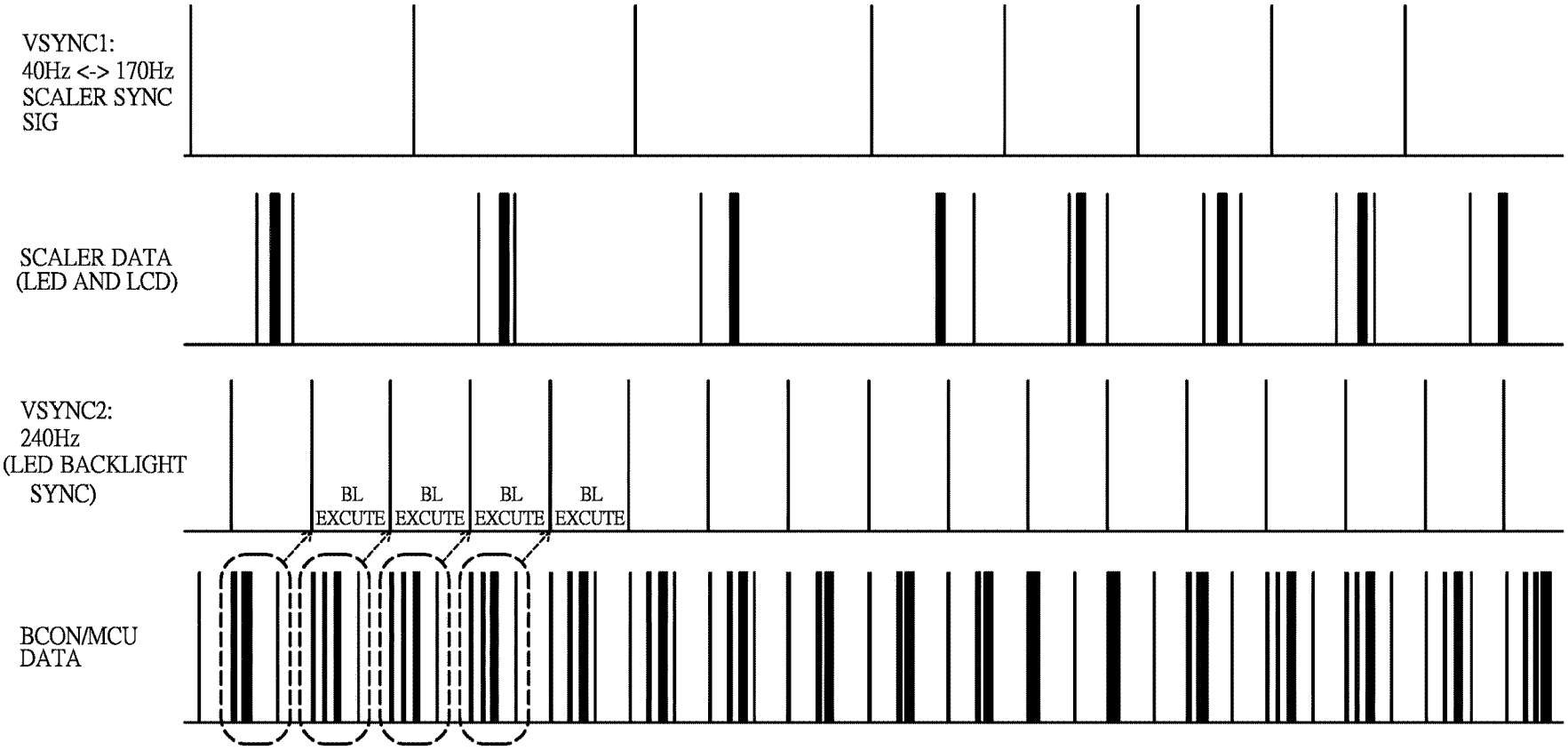

FIG. 10 illustrates the concept of data execution, sometimes known as "update". As shown in FIG. 10, each dashed line rectangle encloses the LED zone dimming data to be transmitted from the BCON/MCU to the LED zone drivers, and that data is only executed on the VSYNC2 edge that follows the data transmission. Although the brightness data may have been transmitted, the light intensity of the particular zone to which the data has been transmitted does not assume the value of the new brightness data until the BL execute signal occurs. All LED zones in the BLU execute their new brightness levels on the VSYNC2 edge.

Figure 11:
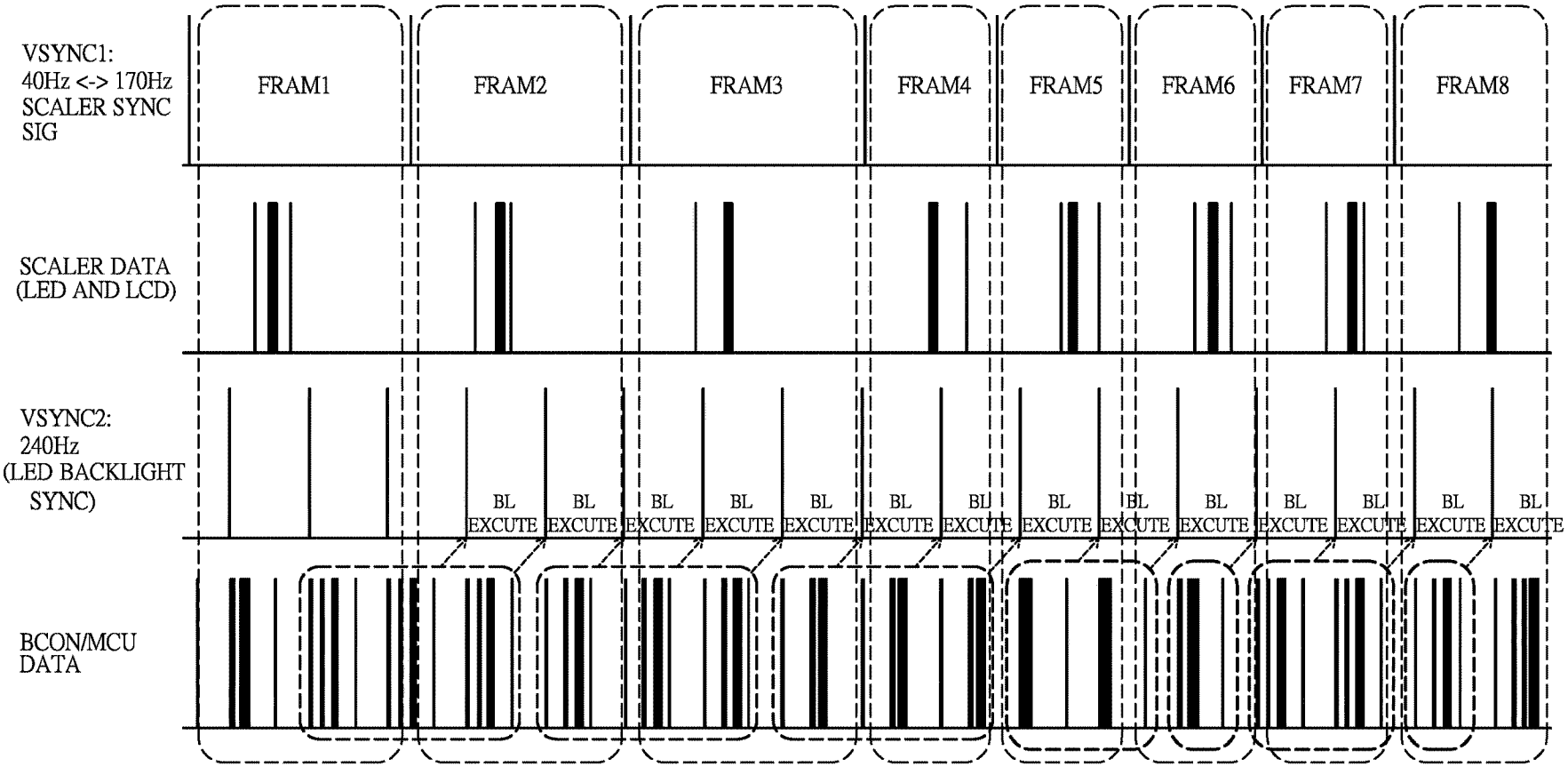

FIG. 11 shows the preceding concepts all put together in one figure. The scaler data output for a frame of LED and LCD data starts inside a large dashed line rectangle on the left (synchronous to the VSYNC1 signal). In the bottom trace that scaler LED data has been converted by the BCON/MCU into 3 bursts of identical brightness data synchronous to the VSYNC2 signal. Each burst of LED brightness data then produce an LED zone with a particular brightness when a corresponding "BL execute" signal occurs.

As we move from left to right the frame period decreases. The scaler data is converted by the BCON/MCU into bursts of LED zone brightness data, but the number of those bursts per frame decrease as the frame period decreases. At the slowest VSYNC1 frequency the algorithm can fit 3 bursts of MCU data into one frame but by the time the VSYNC1 frequency has achieved its maximum value the number of MCU data bursts per frame will vary between one and two. The BCON/MCU chooses its output from the preceding frame data such that the phase error between the LCD image and the backlight LED image is minimized.

Figure 12:
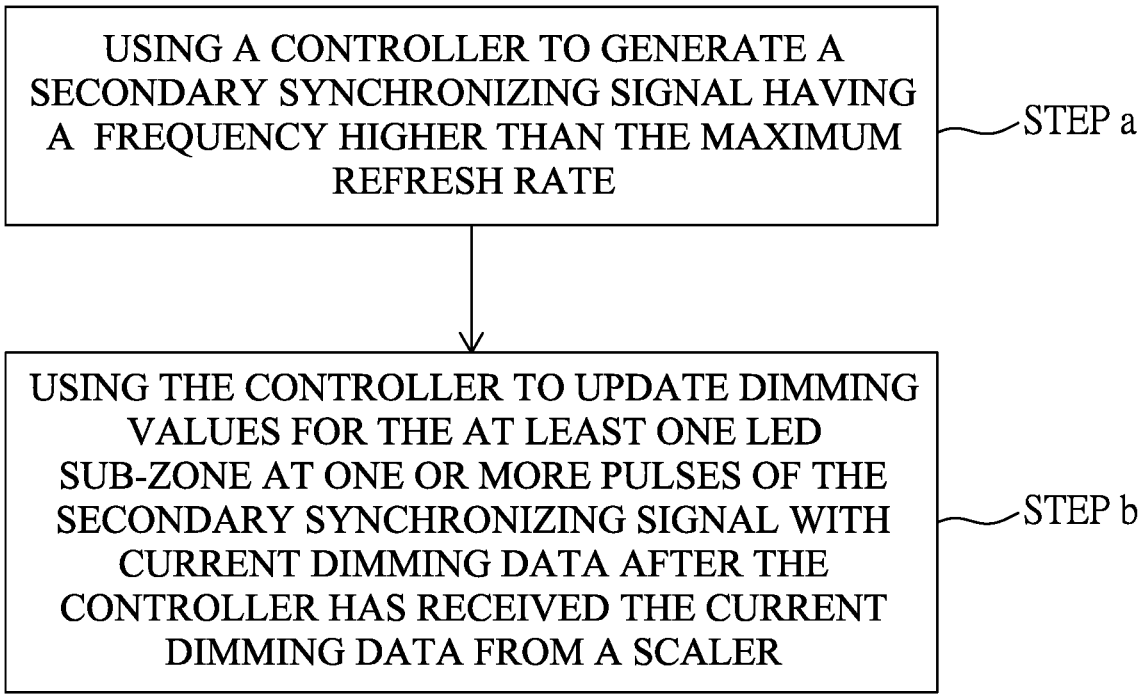
FIG. 12 illustrates a flow chart of the backlight dimming method of the present invention according to an embodiment.

In summary, the invention proposes a backlight dimming method for backlighting an LCD panel having a variable refresh rate with an LED module. Please refer to FIG. 12, which illustrates a flow chart of the backlight dimming method of the present invention according to an embodiment, where the variable refresh rate has a maximum refresh rate, the LED module has at least one LED sub-zone, and the LED sub-zone includes a plurality of LEDs. As shown in FIG. 12, the method including: using a controller to generate a secondary synchronizing signal having a frequency higher than the maximum refresh rate (step a); and using the controller to update dimming values for the at least one LED sub-zone at one or more pulses of the secondary synchronizing signal with current dimming data after the controller has received the current dimming data from a scaler (step b).

In step b, the method further includes using at least one driver circuit to refresh the at least one LED sub-zone once with the current dimming data during a time period between two consecutive pulses of the secondary synchronizing signal; or further includes using at least one driver circuit to refresh the at least one LED sub-zone a plurality of times correspondingly with a plurality of groups of sub-dimming values during a time period between two consecutive pulses of the secondary synchronizing signal, where the plurality of groups of sub-dimming values add up to values of the current dimming data.

Furthermore, the current dimming data can be transmitted in a series format from the scaler.

Furthermore, the current dimming data can be derived by undergoing a series-to-parallel transformation.

Figure 13:
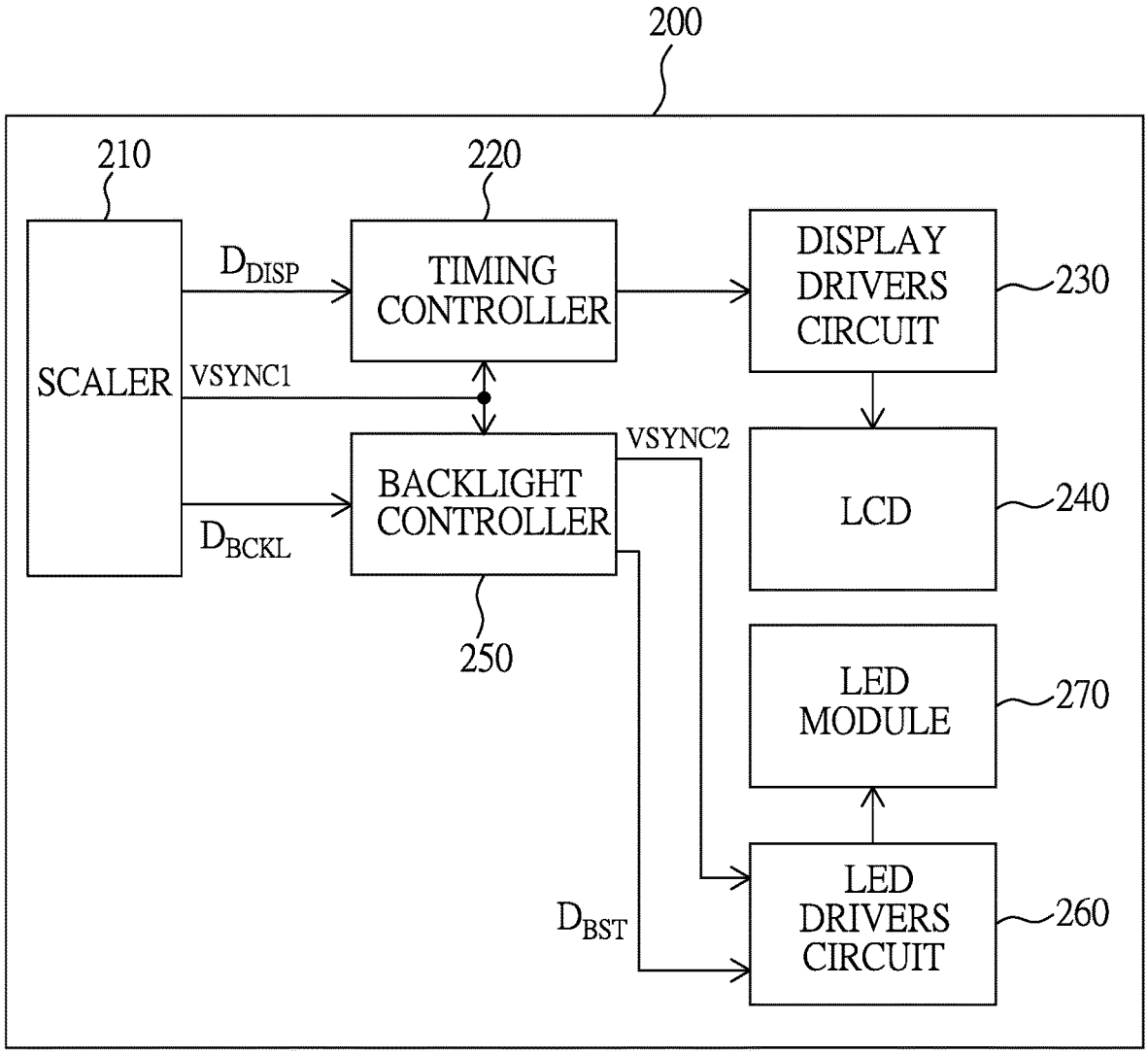
FIG. 13 illustrates a block diagram of a display apparatus according to an embodiment of the present invention.

In addition, the invention proposes a display apparatus using the mentioned control circuit to provide variable refresh rate display. Please refer to FIG. 13, which illustrates a block diagram of a display apparatus according to an embodiment of the present invention. As shown in FIG. 13, a display apparatus 200 including a scaler 210, a timing controller 220, at least one display driver circuit 230, an LCD panel 240, a backlight controller 250, at least one LED driver circuit 260, and an LED module 270 having at least one LED sub-zone, the LED sub-zone including a plurality of LEDs.

The scaler 210 provides a first synchronizing signal VSYNC1 to simultaneously transmit LCD display data $D_{DISP}$ to the timing controller 220 and LED backlight data $D_{BCKL}$ to the backlight controller 250.

The timing controller 220 generates control signals according to the LCD display data $D_{DISP}$ to control the at least one display driver circuit 230 to drive the LCD panel 240 to display an LCD image.

The backlight controller 250 provides a second synchronizing signal VSYNC2, which has a frequency higher than that of the first synchronizing signal VSYNC1, and generates one or more identical data bursts $D_{BST}$ of the LED backlight data $D_{BCKL}$ at one or more pulses of the second synchronizing signal VSYNC2, and the at least one LED driver circuit 260 uses the one or more identical data bursts $D_{BST}$ to update current dimming data for the at least one LED sub-zone of the LED module 270 at one or more pulses of the second synchronizing signal VSYNC2.

In addition, the at least one LED driver circuit 260 can use the current dimming data to drive the LED module 270 once during a period of the second synchronizing signal VSYNC2, or divide the current dimming data into multiple groups of sub-dimming values, and use the multiple groups of sub-dimming values to drive the LED module 270 multiple times during a period of the second synchronizing signal VSYNC2.

In addition, the current dimming data can be transmitted in a series format from the scaler, and the current dimming data can be derived by undergoing a series-to-parallel transformation.

Figure 14:
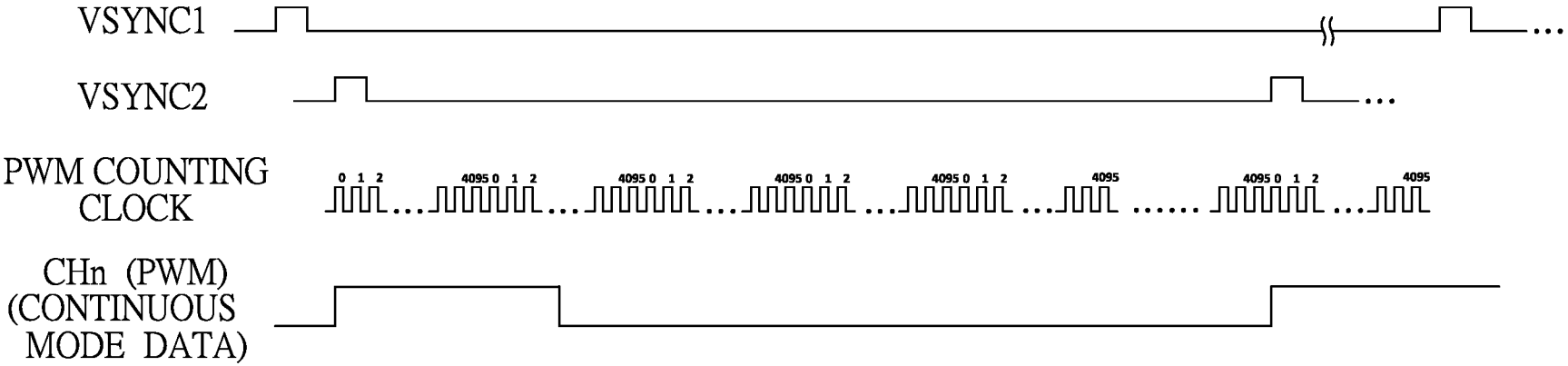
FIG. 14 shows an illustrative timing diagram for a continuous mode backlight refresh operation.
Figure 15:
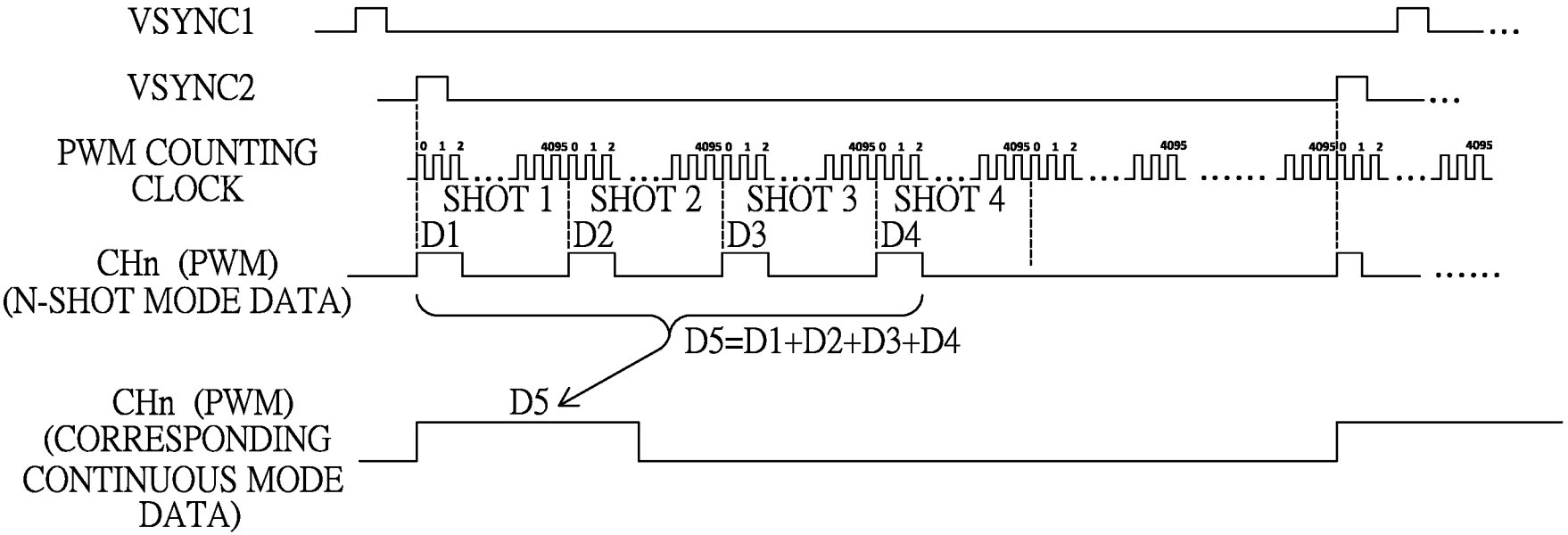
FIG. 15 shows an illustrative timing diagram for an N-shot mode backlight refresh operation.

Using concepts disclosed above, the present invention can therefore provide the advantages as follows:

1. The backlight dimming method of the present invention can utilize an LED backlight module having a refresh rate independent from and higher than a variable refresh rate of an LCD panel, and the LED backlight module refreshes each received frame of dimming data one or more times, thereby supporting a variable refresh rate display. In addition, a driver circuit can be arranged to perform a continuous mode backlight refresh operation (dimming data continuously applied per frame), an illustrative timing diagram of which is shown in FIG. 14; or an N-shot mode backlight refresh operation (dimming data divided into multiple groups and applied in multiple sub-frames per frame), an illustrative timing diagram of which is shown in FIG. 15, to increase backlight refresh rate to improve display effect.

2. The control circuit of the present invention can be used for implementing the aforementioned backlight dimming method to support a variable refresh rate display.

3. The display apparatus of the present invention can utilize the aforementioned control circuit to support a variable refresh rate display.

While the invention has been described by way of example and in terms of preferred embodiments, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

In summation of the above description, the present invention herein enhances the performance over the conventional structure and further complies with the patent application requirements and is submitted to the Patent and Trademark Office for review and granting of the commensurate patent rights.

What is claimed is:

1. A backlight dimming method for backlighting an LCD panel having a variable refresh rate with an LED module, the variable refresh rate having a maximum refresh rate and being determined by a first synchronizing signal having a variable frequency, the LED module having at least one LED sub-zone, the LED sub-zone including a plurality of LEDs, and the method including:

using a controller to generate a secondary synchronizing signal having a frequency higher than the maximum refresh rate, wherein the secondary synchronizing signal is not synchronized with the first synchronizing signal;

using the controller to update dimming values for the at least one LED sub-zone at one or more pulses of the secondary synchronizing signal with current dimming data after the controller has received the current dimming data from a dimming data controller; and using at least one driver circuit to refresh the at least one LED sub-zone a plurality of times with a plurality of groups of sub-dimming values for each said LED subzone during a time period between two consecutive said pulses of the secondary synchronizing signal, wherein the plurality of groups of sub-dimming values add up to a value of the current dimming data for each said LED sub-zone.

2. The backlight dimming method of claim 1, further including using at least one driver circuit to refresh the at least one LED sub-zone once with the current dimming data during a time period between two consecutive said pulses of the secondary synchronizing signal.

3. The backlight dimming method of claim 1, wherein the current dimming data is transmitted in a series format from the dimming data controller.

4. The backlight dimming method of claim 1, wherein the current dimming data is derived by undergoing a series-to-parallel transformation.

5. A control circuit having a controller and a driver circuit for performing a backlight dimming method for backlighting an LCD panel having a variable refresh rate with an LED module, the variable refresh rate having a maximum refresh rate and being determined by a first synchronizing signal having a variable frequency, the LED module having at least one LED sub-zone, the LED sub-zone including a plurality of LEDs, and the method including:

using the controller to generate a secondary synchronizing signal having a frequency higher than the maximum refresh rate, wherein the secondary synchronizing signal is not synchronized with the first synchronizing signal; and using the controller to update dimming values for the at least one LED sub-zone at one or more pulses of the secondary synchronizing signal with current dimming data after the controller has received the current dimming data from a dimming data controller;

wherein the at least one driver circuit is used to refresh the at least one LED sub-zone a plurality of times with a plurality of groups of sub-dimming values for each said LED subzone during a time period between two consecutive said pulses of the secondary synchronizing signal, wherein the plurality of groups of sub-dimming values add up to a value of the current dimming data for each said LED sub-zone.

6. The control circuit of claim 5, wherein the at least one driver circuit is used to refresh the at least one LED sub-zone once with the current dimming data during a time period between two consecutive said pulses of the secondary synchronizing signal.

7. The control circuit of claim 5, wherein the current dimming data is transmitted in a series format from the dimming data controller.

8. The control circuit of claim 5, wherein the current dimming data is derived by undergoing a series-to-parallel transformation.

9. A display apparatus comprising a control circuit, an LCD panel having a variable refresh rate and an LED module having at least one LED sub-zone, the LED sub-zone including a plurality of LEDs, the control circuit having a controller and at least one driver circuit for performing a backlight dimming method for backlighting the LCD panel with the LED module, the variable refresh rate having a maximum refresh rate and being determined by a first synchronizing signal having a variable frequency, and the method including:

using the controller to generate a secondary synchronizing signal having a frequency higher than the maximum refresh rate, wherein the secondary synchronizing signal is not synchronized with the first synchronizing signal; and using the controller to update dimming values for the at least one LED sub-zone at one or more pulses of the secondary synchronizing signal with current dimming data after the controller has received the current dimming data from a dimming data controller;

wherein the at least one driver circuit is used to refresh the at least one LED sub-zone a plurality of times with a plurality of groups of sub-dimming values for each said LED subzone during a time period between two consecutive said pulses of the secondary synchronizing signal, wherein the plurality of groups of sub-dimming values add up to a value of the current dimming data for each said LED sub-zone.

10. The display apparatus of claim 9, wherein the at least one driver circuit is used to refresh the at least one LED sub-zone once with the current dimming data during a time period between two consecutive said pulses of the secondary synchronizing signal.

11. The display apparatus of claim 9, wherein the current dimming data is transmitted in a series format from the dimming data controller.

12. The display apparatus of claim 9, wherein the current dimming data is derived by undergoing a series-to-parallel transformation.

* * * * *